US008672369B2

(12) United States Patent
Mazur et al.

(10) Patent No.: US 8,672,369 B2
(45) Date of Patent: Mar. 18, 2014

(54) DOOR LOCK INDICATOR ARM

(75) Inventors: Lorin A. Mazur, Shelby, MI (US); James C. O'Kane, Shelby Township, MI (US); Sara M Repen, Farmington, MI (US); Kouichi Inaba, Farmington Hills, MI (US); Rinaldo M. Lucchesi, Rochester Hills, MI (US); James Axiotis, Auburn Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 581 days.

(21) Appl. No.: 12/763,429

(22) Filed: Apr. 20, 2010

(65) Prior Publication Data

US 2011/0252708 A1 Oct. 20, 2011

(51) Int. Cl.
*E05C 3/16* (2006.01)
*E05C 21/00* (2006.01)

(52) U.S. Cl.
USPC ..... 292/216; 292/1; 292/174; 292/227; 292/DIG. 23; 292/DIG. 37; 292/DIG. 38; 296/146.6

(58) Field of Classification Search
USPC ..... 292/1, 30, 40, 41, 52, 53, 66, 85, 86, 292/100, 113, 118, 119, 126, 127, 134, 135, 292/143, 161, 166, 168, 173, 174, 188, 200, 292/216, 217, 221, 226, 227, 236, 237, 292/DIG. 15, DIG. 23, DIG. 37, DIG. 38, 292/DIG. 63, DIG. 73; 296/146.5, 146.6; 49/503, 506
See application file for complete search history.

(56) References Cited

U.S. PATENT DOCUMENTS

| | | | | | |
|---|---|---|---|---|---|
| 1,214,892 | A | * | 2/1917 | Budd | 49/503 |
| 1,395,477 | A | * | 11/1921 | Budd | 292/173 |
| 1,441,151 | A | * | 1/1923 | Hitchcock | 292/170 |
| 1,530,341 | A | * | 3/1925 | Bannochie | 292/220 |
| 2,234,810 | A | * | 3/1941 | Simpson | 292/221 |
| 2,480,688 | A | * | 8/1949 | Allen | 292/216 |
| 2,658,781 | A | * | 11/1953 | Allen | 292/216 |
| 2,658,782 | A | * | 11/1953 | Allen | 292/216 |
| 2,658,783 | A | * | 11/1953 | Allen | 292/216 |
| 2,734,761 | A | * | 2/1956 | Allen | 292/216 |
| 4,369,000 | A | * | 1/1983 | Egnew | 403/13 |
| 4,458,930 | A | * | 7/1984 | Goike et al. | 292/201 |
| 4,606,567 | A | | 8/1986 | Kato et al. | |

(Continued)

FOREIGN PATENT DOCUMENTS

| | | | |
|---|---|---|---|
| DE | 10110516 | A1 | 9/2002 |
| DE | 102006040088 | A1 | 3/2008 |

*Primary Examiner* — Carlos Lugo
*Assistant Examiner* — Alyson M Merlino
(74) *Attorney, Agent, or Firm* — Quinn Law Group, PLLC

(57) ABSTRACT

A lock indicator arm for a door having a latch mechanism includes a rod portion connectable on a first end to the latch mechanism, and a knob portion located on a second end of the rod portion opposite the first end and formed as a one-piece structure with the rod portion. The rod portion may include a spring region configured to bias the rod portion against either an interior panel, an exterior panel, or both panels. The knob portion and the rod portion of the lock indicator arm may be formed from a matrix material and a filler material. The filler material may include a plurality of fibers, and the plurality of fibers may be oriented substantially longitudinally along the rod portion. The rod portion of the lock indicator arm may have one of an H-shape cross section and a W-shape cross section.

16 Claims, 2 Drawing Sheets

(56) References Cited

U.S. PATENT DOCUMENTS

| | | | | | |
|---|---|---|---|---|---|
| 4,876,143 | A * | 10/1989 | Sugita et al. | 428/298.4 |
| 5,189,962 | A * | 3/1993 | Iwamura et al. | 105/218.2 |
| 5,234,237 | A * | 8/1993 | Gergoe et al. | 292/201 |
| 5,845,947 | A * | 12/1998 | Arabia et al. | 292/1 |
| 6,156,986 | A * | 12/2000 | Tsai | 200/345 |
| 6,390,708 | B1 * | 5/2002 | Gueret | 401/122 |
| 6,460,839 | B2 * | 10/2002 | Muller | 267/221 |
| 6,578,446 | B2 * | 6/2003 | Staser et al. | 74/519 |
| 6,652,021 | B1 * | 11/2003 | Dykman et al. | 296/214 |
| 6,758,511 | B2 * | 7/2004 | Taylor et al. | 296/121 |
| 6,805,398 | B2 | 10/2004 | Harima et al. | |
| 2003/0006625 | A1 * | 1/2003 | Moriyama et al. | 296/146.6 |
| 2006/0283215 | A1 | 12/2006 | Manthe et al. | |
| 2007/0138808 | A1 | 6/2007 | Barlow, Jr. | |
| 2009/0064591 | A1 * | 3/2009 | Keller et al. | 49/358 |

* cited by examiner

DOOR LOCK INDICATOR ARM

TECHNICAL FIELD

This disclosure relates generally to vehicle doors, and more-specifically to lock actuators or indicators for vehicle doors.

BACKGROUND

Vehicle doors may generally be formed from at least three layers or panels. An exterior body panel may be the layer viewed from the outside of the vehicle. An interior trim panel may be the layer viewed from the interior or cabin of the vehicle, and may include door pull handles or cups along with mounting surfaces for controls such as window buttons and door locks. An outer sheet metal panel may be intermediate the exterior body panel and the interior trim panel. The outer sheet metal panel may be structural and provide the attachment points for the interior trim panel and door hardware, such as locks and window motors.

SUMMARY

A lock indicator arm for a door having a latch mechanism is provided. The lock indicator arm includes a rod portion connectable on a first end to the latch mechanism. A knob portion is located on a second end of the rod portion opposite the first end, and is formed as a one-piece (single, continuous) structure with the rod portion.

The door into which the lock indicator arm is placed may include an interior panel and an exterior panel. The rod portion may further include a spring region which is configured to bias the rod portion against either the interior panel, the exterior panel, or both panels.

The knob portion and the rod portion of the lock indicator arm may be formed from a matrix material and a filler material. The filler material may include a plurality of fibers, and the plurality of fibers may be oriented substantially longitudinally along the rod portion. The rod portion of the lock indicator arm may have one of an H-shape cross section and a W-shape cross section.

The above features and advantages and other features and advantages of the present invention are readily apparent from the following detailed description of the best modes and other embodiments for carrying out the invention when taken in connection with the accompanying drawings.

DETAILED DESCRIPTION

Figure 1:
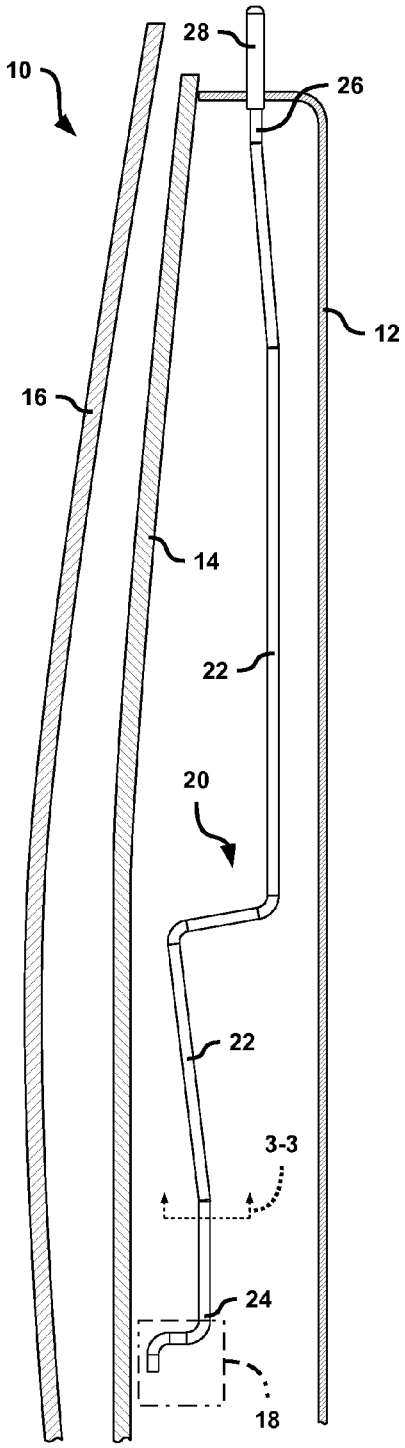
FIG. 1 is a schematic cross-sectional view of a vehicle door having a one-piece lock indicator arm located therein.

Referring to the drawings, wherein like reference numbers correspond to like or similar components throughout the several figures, there is shown in FIG. 1 a highly schematic cross-sectional view of a vehicle door 10. The door 10 includes three or more panels or layers. A trim panel or interior panel 12 may be utilized as the surface viewed by vehicle occupants from the interior of the vehicle. The interior panel 12 may be, for example, plastic and may be covered in cloth, leather, or accent metals. A sheet metal panel or exterior panel 14 may provide the structure for the door 10 and may include fasteners or hardware to which the interior panel 12 is attached. A body panel 16 is located on the outside of the door 10 and may be the surface viewed by those outside of the vehicle. The body panel 16 may be formed from metal or plastic and is often painted.

While much of the present invention is described in detail with respect to automotive applications, those skilled in the art will recognize the broader applicability of the invention. Those having ordinary skill in the art will also recognize that terms such as "above," "below," "upward," "downward," et cetera, are used descriptively of the figures, and do not represent limitations on the scope of the invention, as defined by the appended claims.

The door 10 may be configured such that the exterior panel 14 acts as a barrier against the passage of dirt, debris, and moisture. Alternatively the exterior panel 14 may have a vapor barrier (not shown) attached thereto to prevent the passage of moisture. In either case, the chamber formed between the exterior panel 14 and the interior panel 12 is, therefore, substantially sealed against ambient conditions outside of the vehicle. A latch mechanism 18 (shown schematically in dashed lines) is disposed intermediate the exterior panel 14 and the interior panel 12. The latch mechanism 18 selectively allows and restricts opening and closing of the door 10. The latch mechanism 18, alone or in combination with other components, may control locking and unlocking of the door 10.

A lock indicator arm 20 for a door 10 is also disposed intermediate the exterior panel 14 and the interior panel 12. The lock indicator arm 20 may be used as one of the actuators for unlocking and locking the door 10 through the latch mechanism 18. Alternatively, the lock indicator arm 20 may be used only as a status indicator of the unlocked or locked state of the latch mechanism 18.

The lock indicator arm 20 has a rod portion 22 connectable on a first end 24 to the latch mechanism 18. The first end 24 may extend substantially into the latch mechanism 18 or may interact with other actuators—such as, without limitation, buttons or levers—to actuate the latch mechanism 18.

A second end 26 of the rod portion 22 is opposite the first end 24, and has a knob portion 28 formed thereon. The knob portion 28 extends through or above (as viewed in FIG. 1) the interior panel 12. The lock indicator arm 20 may be moved by pushing or pulling on the knob portion 28 to actuate the latch mechanism 18. Similarly, actuation of the latch mechanism 18—such as, without limitation, by electronic controls—may be reflected by movement of the lock indicator arm 20 up or down (as viewed in FIG. 1).

The knob portion 28 is formed as a one-piece structure with the rod portion 22. The knob portion 28 and rod portion 22 are elements formed as a single piece, such that the two elements are part of one, contiguous piece (the lock indicator arm 20) and are not formed from two or more pieces which are simply attached or assembled. The lock indicator arm 20 may be formed by, for example, and without limitation: casting or injection molding the whole lock indicator arm 20—including the rod portion 22 and the knob portion 28—in substantially one forming or manufacturing process. As further discussed herein, the lock indicator arm 20 may be formed from one or more plastic or plastic-like materials, such as polypropylene (PP).

Figure 2:
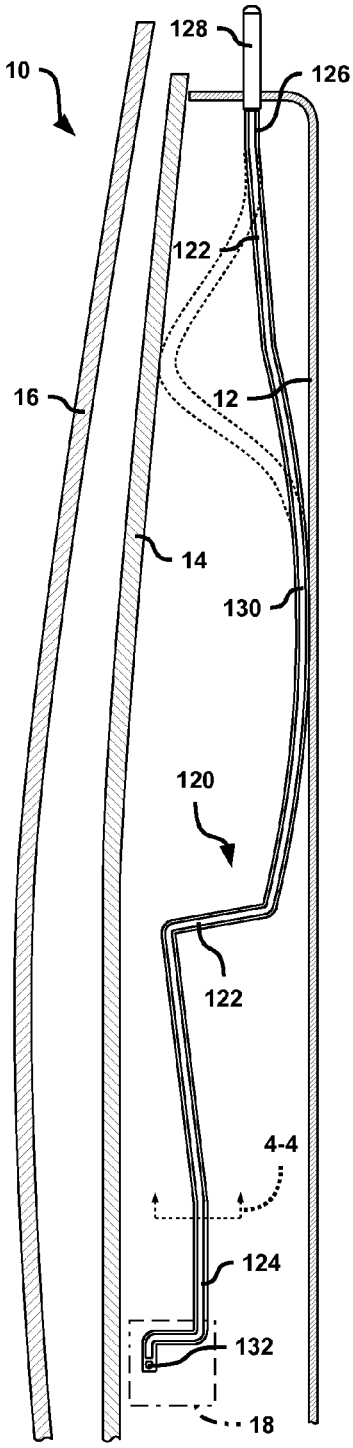
FIG. 2 is a schematic cross-sectional view of the vehicle door shown in FIG. 1 having a one-piece lock indicator arm with a spring feature biasing a portion of the arm against one of the panels of the vehicle door.

Referring now to FIG. 2, and with continued reference to FIG. 1, there is shown the door 10, or a similar vehicle door, including the interior panel 12, exterior panel 14, and body panel 16. The exterior panel 14 acts as a barrier against the passage of dirt, debris, and moisture and the latch mechanism 18 (again shown schematically in dashed lines) is disposed intermediate the exterior panel 14 and the interior panel 12.

A lock indicator arm 120 for the door 10 is also disposed intermediate the exterior panel 14 and the interior panel 12. The lock indicator arm 120 may be used as one of the actuators for unlocking and locking the door 10 through the latch mechanism 18.

Similar to the locking indicator arm 20 shown in FIG. 1, the lock indicator arm 120 has a rod portion 122 connectable on a first end 124 to the latch mechanism 18. The first end 124 may extend substantially into the latch mechanism 18 or may interact with other actuators—such as, without limitation, buttons, levers, or electronic actuators—to actuate the latch mechanism 18. A second end 126 of the rod portion 122 is opposite the first end 124, and has a knob portion 128 formed thereon.

The rod portion 122 of the lock indicator arm 120 shown in FIG. 2 further includes at least one spring feature or spring region 130. The spring region 130 is configured to bias the rod portion 122 against the interior panel 12. Alternatively, though not shown in the figures, the spring region 130 could be configured to bias the rod portion 122 against the exterior panel 14. Furthermore, multiple spring regions 130 or a complex-shaped spring region 130 could bias the rod portion 122 against both the interior panel 12 and the exterior panel 14, giving the rod portion 122 a generally S-shaped profile when viewed from an angle similar to that shown in FIGS. 1 and 2, as illustrated in shadow in FIG. 2.

The spring feature 130 creates pressure and friction between the rod portion 122 and the interior panel 12. Therefore, when the door 10 is open and closed, or when the vehicle experiences vibrations or bumps, the lock indicator arm 120 is less likely to oscillate and less likely to impact the interior panel 12 or the exterior panel 14. Reduction or prevention of multiple impacts may reduce the chance of shake and rattle sounds from the door 10. Furthermore, the lock indicator arm 120 is less likely to impact—or to move away from and then impact—the interior panel 12 or the exterior panel 14 during actuation of the lock indicator arm 120 and the latch mechanism 18.

As shown in FIG. 2, the lock indicator arm 120 further includes a snap feature 132 on the first end 124 of the rod portion 122. The snap feature 132 is configured to be mated to the latch mechanism 18. The snap feature 132 is also formed as a unitary portion of the one-piece lock indicator arm 120 and may be molded or injected simultaneously with the remainder of the lock indicator arm 120 or may be separately formed through post-processing or machining.

The snap feature 132 may cooperate with a corresponding or reciprocal snap feature (not shown) of the latch mechanism 18 or may interact with a grasping feature (not shown) configured to restrain the snap feature 132 and facilitate load transfer between the latch mechanism 18 and the lock indicator arm 120. The lock indicator arm 20 shown in FIG. 1 may also be configured with a snap feature.

Figure 3:
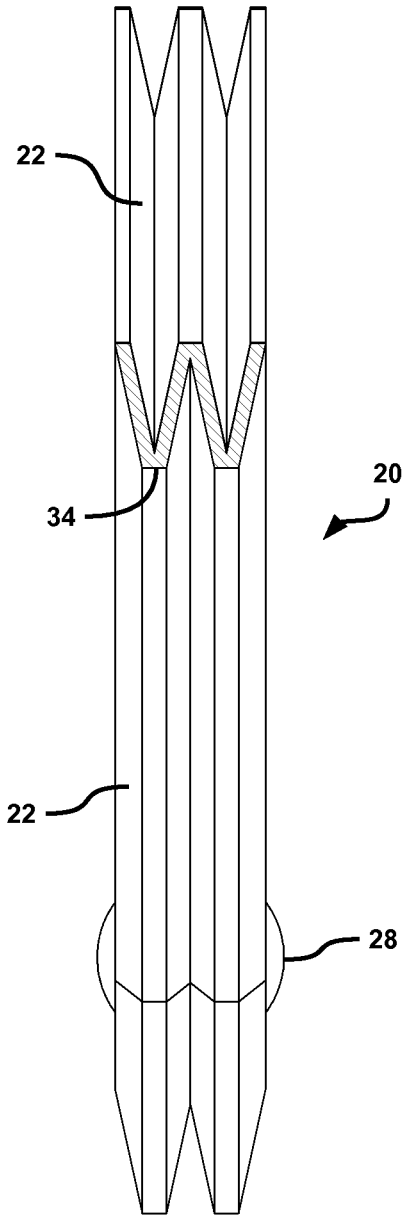
FIG. 3 is a schematic cross-sectional view taken along line 3-3 of the one-piece lock indicator arm shown in FIG. 1, displaying a W-shape cross section.

Referring now to FIG. 3, and with continued reference to FIGS. 1 and 2, there is shown a cross-sectional view of the lock indicator arm 20 taken along line 3-3 of FIG. 1. Both the lock indicator arm 20 shown in FIG. 1 and the lock indicator arm 120 shown in FIG. 2 have non-circular cross sections throughout most, or all, of the length of the rod portion 22 and the rod portion 122, respectively.

As shown in FIG. 3, the rod portion 22 of the lock indicator arm 20 has a W-shape cross section, such that a plane section 34 generally has an outline resembling the letter "W." The plane section 34 need not have the exact W-shape and proportions shown in FIG. 3. For example, the plane section 34 may be altered by: rotating the W-shape (such that it would be viewed on its side or at an angle in FIG. 3), filleting or rounding the corners and edges, and altering the relative size or length of the arms of the W-shape. Because the knob portion 28 is viewable to the occupants of the vehicle and is the portion with which the occupants interact, the knob portion 28 may have a round or rounded cross section.

Figure 4:
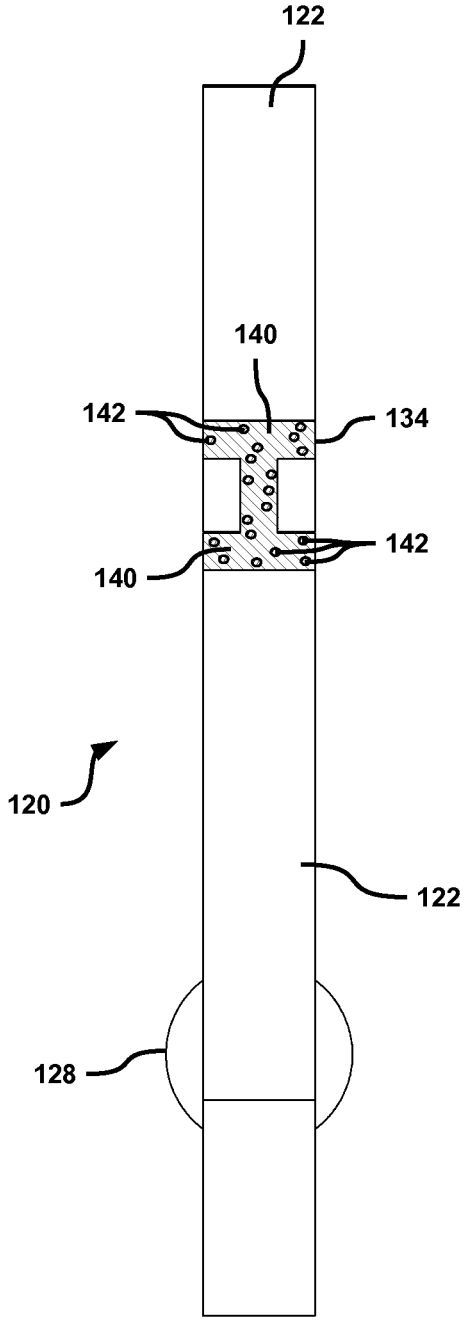
FIG. 4 is a schematic cross-sectional view taken along line 4-4 of the one-piece lock indicator arm shown in FIG. 2, displaying an H-shape cross section and showing a matrix and a filler, the filler including a plurality of longitudinally-oriented fibers.

Referring now to FIG. 4, and with continued reference to FIGS. 1-3, there is shown a cross-sectional view of the lock indicator arm 120 taken along line 4-4 of FIG. 2. As shown in FIG. 4, the rod portion 122 of the lock indicator arm 120 has an H-shape cross section, such that a plane section 134 generally has an outline resembling the letter "H," or a rotated letter "I." The plane section 134 need not have the exact H-shape and proportions shown in FIG. 4. For example, depending upon the relative length of the arms of the H-shape, the plane section 134 may resemble an I-bar or I-beam. Both the lock indicator arm 20 shown in FIG. 1 and the lock indicator arm 120 shown in FIG. 2 may be configured with either the W-shape or the H-shape cross section along the respective plane sections 34 or 134.

The lock indicator arm 120 shown in FIG. 4 is formed from composite materials. The knob portion 128 and the rod portion 122 are formed from a matrix material 140 and a filler material 142. The matrix material 140 may be, for example, polypropylene, and the filler material 142 may be, for example, a plurality of fibers. The fibers of the filler material 142 may be glass fibers, or long glass fibers. Similarly, the W-shape cross section of the lock indicator arm 20 shown in FIG. 3 may also be formed from composite materials, including a similar matrix and filler structure to that shown in FIG. 4. Alternatively filler materials 142 may be glass beads, aramid fibers, carbon fibers, or another suitable filler recognizable to those having ordinary skill in the art.

As shown in FIG. 4, the glass fibers of the filler material 142 are oriented substantially longitudinally along the rod portion 122, such that most of the fibers are longitudinally-oriented. As used herein, longitudinally-oriented refers to fibers being oriented perpendicular to the H-shape or W-shape cross section of the rod portion 122. Due to manufacturing variability, the fibers may not be exactly or perfectly longitudinally-oriented and may sit at an angle to any specific cross-sectional plane in the rod portion 122. A small number of the fibers may even end up oriented transversely or randomly. However, if many of the plurality of glass fibers are generally longitudinally-oriented, the strength and load-carrying capacity of the lock indicator arm 120 may be increased as compared to all of the fibers being randomly oriented throughout the rod portion 122.

The fibers of the filler material 142 may be oriented and aligned longitudinally during the manufacturing process of the lock indicator arm 120 (or the lock indicator arm 20, if similarly constructed with a fiber filler). The lock indicator arm 120 may be manufactured by, for example and without limitation, injecting the matrix material 140 and the filler material 142 into a female mold from only one end of the lock indicator arm 120, such as the knob portion 128. As the matrix material 140 and the filler material 142 are injected from the knob portion 128 through the length of the rod portion 122 (or vise versa), the long glass fibers of the filler material 142 will align and orient longitudinally along the rod portion 122.

While the best modes and other embodiments for carrying out the claimed invention have been described in detail, those familiar with the art to which the invention relates will recognize various alternative designs and embodiments for practicing the invention, as defined in the appended claims.

The invention claimed is:

1. A lock indicator arm for a door having a latch mechanism, an interior panel and an exterior panel, and the lock indicator arm comprising:

a rod portion connectable on a first end to the latch mechanism, wherein the rod portion has one of an H-shape cross section and a W-shape cross section, and a spring region configured to bias the rod portion against one of the interior panel and the exterior panel; and a knob portion on a second end of the rod portion opposite the first end, wherein the knob portion is formed as a one-piece structure with the rod portion.

2. The lock indicator arm of claim 1, wherein the knob portion and the rod portion are formed from a matrix material and a filler material; and wherein the filler material includes a plurality of fibers.

3. The lock indicator arm of claim 2, wherein the plurality of fibers are oriented substantially longitudinally along the rod portion.

4. The lock indicator arm of claim 3, wherein the filler material is glass and the matrix material is polypropylene.

5. The lock indicator arm of claim 4, wherein the rod portion further includes:

a snap feature on the first end of the rod portion; and wherein the snap feature is configured to be mated to the latch mechanism.

6. The lock indicator arm of claim 5, wherein the exterior panel is configured as a barrier against passage of moisture, and wherein the lock indicator arm is disposed intermediate the exterior panel and the interior panel.

7. The lock indicator arm of claim 6, wherein the spring region is configured to bias the rod portion against both the interior panel and the exterior panel.

8. A lock indicator arm for a door having a latch mechanism, an interior panel, and an exterior panel, the lock indicator arm comprising:

a rod portion connectable on a first end to the latch mechanism and having a spring region that biases the rod portion against at least one of the interior panel and the exterior panel; and a knob portion on a second end of the rod portion opposite the first end, wherein the knob portion is formed as a one-piece structure with the rod portion.

9. The lock indicator arm of claim 8, wherein the knob portion and the rod portion are formed from a matrix material and a filler material.

10. The lock indicator arm of claim 9, wherein the matrix material is polypropylene.

11. The lock indicator arm of claim 10, wherein the filler material is a plurality of glass fibers.

12. The lock indicator arm of claim 11, wherein the plurality of glass fibers are oriented substantially longitudinally along the rod portion.

13. The lock indicator arm of claim 12, wherein the rod portion has an H-shape cross section.

14. The lock indicator arm of claim 13, wherein the rod portion has a W-shape cross section.

15. The lock indicator arm of claim 13, wherein the exterior panel is configured as a barrier against passage of moisture, and wherein the entire rod portion is disposed intermediate the exterior panel and the interior panel.

16. The lock indicator arm of claim 8, wherein the spring region biases the rod portion against both the interior panel and the exterior panel.

* * * * *